US010603920B2

(12) United States Patent
Sugai

(10) Patent No.: US 10,603,920 B2
(45) Date of Patent: Mar. 31, 2020

(54) LIQUID EJECTING APPARATUS

(71) Applicant: SEIKO EPSON CORPORATION, Tokyo (JP)

(72) Inventor: Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/201,038

(22) Filed: Nov. 27, 2018

(65) Prior Publication Data

US 2019/0160827 A1 May 30, 2019

(30) Foreign Application Priority Data

Nov. 30, 2017 (JP) ..... 2017-229731

(51) Int. Cl.
*B41J 2/18* (2006.01)
*B41J 2/175* (2006.01)

(52) U.S. Cl.
CPC ..... *B41J 2/18* (2013.01); *B41J 2/175* (2013.01)

(58) Field of Classification Search
CPC ..... B41J 2/18; B41J 2/175
See application file for complete search history.

(56) References Cited

U.S. PATENT DOCUMENTS

2006/0232640 A1* 10/2006 Ota ..... B41J 2/14233 347/68
2007/0279460 A1 12/2007 Yokoyama et al.
2009/0115817 A1* 5/2009 Suzuki ..... B41J 2/14274 347/45
2009/0293871 A1 12/2009 Kitakami
2011/0304662 A1* 12/2011 Yokoyama ..... B41J 2/14233 347/9

FOREIGN PATENT DOCUMENTS

JP 2007-320042 A 12/2007
JP 2009-286047 A 12/2009

* cited by examiner

*Primary Examiner* — Kristal Feggins
(74) *Attorney, Agent, or Firm* — Workman Nydegger

(57) ABSTRACT

A liquid ejecting apparatus includes: a pressure chamber configured to communicate with a nozzle hole through which a liquid is discharged; a liquid chamber having a first opening configured to communicate with the pressure chamber; a first slide section arranged in the liquid chamber and having a first through-hole at a position corresponding to the first opening; and a driving device configured to drive the first slide section along a predetermined direction. The first slide section slides, by being driven by the driving device, along the predetermined direction on an inner wall surface having the first opening of the liquid chamber, and changes, by changing an area where the first opening and the first through-hole overlap with each other, an opening degree of the first opening, and the first slide section makes linear contact with the inner wall surface having the first opening along the predetermined direction.

1 Claim, 14 Drawing Sheets

LIQUID EJECTING APPARATUS

BACKGROUND

1. Technical Field

The present invention relates to a liquid ejecting apparatus.

2. Related Art

As for a liquid ejecting apparatus, for example, JP-A-2007-320042 discloses a liquid ejecting apparatus in which a plate is provided on a wall surface in a liquid chamber and the plate is driven so as to slide on the wall surface.

In the liquid ejecting apparatus disclosed in JP-A-2007-320042, with sliding of a slide section (plate), heat generation occurs due to friction at a contact area between the slide section and the liquid chamber. In a case where this heat generation is large, viscosity of a liquid in the liquid chamber drops, and there is a risk that discharge stability of the liquid discharged through a nozzle hole will drop.

SUMMARY

An advantage of some aspects of the invention is to solve at least part of the problems described above, and the invention can be achieved as the following forms.

1. According to an aspect of the invention, a liquid ejecting apparatus is provided. This liquid ejecting apparatus includes: a pressure chamber configured to communicate with a nozzle hole through which a liquid is discharged; a liquid chamber having a first opening configured to communicate with the pressure chamber; a first slide section arranged in the liquid chamber and having a first through-hole at a position corresponding to the first opening; and a driving device configured to drive the first slide section along a predetermined direction. The first slide section slides, by being driven by the driving device, along the direction on an inner wall surface having the first opening of the liquid chamber, and changes, by changing an area where the first opening and the first through-hole overlap with each other, an opening degree of the first opening, and the first slide section makes linear contact with the inner wall surface having the first opening along the direction. With the liquid ejecting apparatus according to this aspect, a contact area between the first slide section and the inner wall surface of the liquid chamber can be reduced, and thus heat generation due to friction at the contact area can be reduced. Accordingly, viscosity of the liquid in the liquid chamber can be suppressed from dropping, and discharge stability of the liquid discharged through the nozzle hole can be suppressed from dropping.

2. In the liquid ejecting apparatus according to the above-described aspect, it is preferable that the inner wall surface of the liquid chamber include a recessed portion having a groove shape extending along the direction, and the first opening be formed in the recessed portion. According to the liquid ejecting apparatus of this form, the first slide section is driven so as to be guided by the recessed portion having the groove shape of the liquid chamber, and thus positioning accuracy of the first slide section in the liquid chamber can be improved.

3. In the liquid ejecting apparatus according to the above-described aspect, it is preferable that a cross-section of the first slide section perpendicular to the direction have a circular arc shape. According to the liquid ejecting apparatus of this form, a volume of the first slide section can be made smaller than that in a case where the first slide section is formed in a column with the same diameter, and thus a capacity of the liquid chamber can be secured, and the liquid chamber can be reduced in size.

4. In the liquid ejecting apparatus according to the above-described aspect, it is preferable that a surface of the first slide section on an opposite side from a side on which the first slide section makes linear contact with the inner wall surface be a flat surface. According to the liquid ejecting apparatus of this form, the flat surface portion of the first slide section can be used as a rotation suppressing mechanism of the first slide section, and thus the positioning accuracy of the first slide section in the liquid chamber can be improved.

5. In the liquid ejecting apparatus according to the above-described aspect, it is preferable that a cross-section of the first slide section perpendicular to the direction have a hollow, and an internal space of the hollow of the first slide section form part of the liquid chamber. According to the liquid ejecting apparatus of this form, the part of the liquid chamber can be provided in the inside of the first slide section, and thus the liquid chamber can be reduced in size.

6. It is preferable that the liquid ejecting apparatus according to the above-described aspect include a plurality of the pressure chambers, in which the liquid chamber includes a plurality of the first openings that respectively enables the pressure chambers and the liquid chamber to communicate with each other, the plurality of first openings is arrayed along the direction, and the first slide section includes a plurality of the first through-holes at positions corresponding to the plurality of first openings, respectively. According to the liquid ejecting apparatus of this form, the plurality of first openings can be opened or closed by a pair of the first slide section and the driving device, and thus, in comparison with a case where the first slide section and the driving device are provided for each of the plurality of first openings, the liquid ejecting apparatus can be reduced in size.

7. It is preferable that the liquid ejecting apparatus according to the above-described aspect include a circulation flow path communicating with a second opening of the liquid chamber and for circulating the liquid in the liquid chamber to a liquid tank, and a second slide section arranged in the liquid chamber and having a second through-hole at a position corresponding to the second opening, in which the liquid chamber communicates with the liquid tank through a supply flow path, the second slide section slides, by being driven by the driving device, along the direction on an inner wall surface having the second opening of the liquid chamber, and changes, by changing an area where the second opening and the second through-hole overlap with each other, an opening degree of the second opening, and the second slide section makes linear contact with the inner wall surface having the second opening along the direction. According to the liquid ejecting apparatus of this form, a contact area between the second slide section and the inner wall surface of the liquid chamber can be reduced, and thus heat generation due to friction at the contact area can be reduced. Accordingly, in a case where the second slide section for opening or closing the second opening communicating with the circulation flow path is provided in the liquid chamber as well, the viscosity of the liquid in the liquid chamber can be suppressed from dropping, and the discharge stability of the liquid discharged through the nozzle hole can be suppressed from dropping.

8. In the liquid ejecting apparatus according to the above-described aspect, it is preferable that the first slide section and the second slide section be integrally formed. According to the liquid ejecting apparatus of this form, the first opening communicating with the pressure chamber and the second opening communicating with the circulation flow path can be opened or closed by a pair of the slide section and the driving device, and thus the liquid ejecting apparatus can be reduced in size.

9. In the liquid ejecting apparatus according to the above-described aspect, it is preferable that the liquid chamber communicate with the liquid tank through the supply flow path, the liquid in the liquid chamber flow into the pressure chamber through the first opening, and the pressure chamber communicate with a circulation flow path for circulating the liquid in the pressure chamber to the liquid tank. According to the liquid ejecting apparatus of this form as well, the contact area between the first slide section and the inner wall surface of the liquid chamber can be reduced, and thus the heat generation due to the friction at the contact area can be reduced. Accordingly, the viscosity of the liquid in the liquid chamber can be suppressed from dropping, and the discharge stability of the liquid discharged through the nozzle hole can be suppressed from dropping.

10. In the liquid ejecting apparatus according to the above-described aspect, it is preferable that the pressure chamber communicate with the liquid tank through the supply flow path, the liquid in the pressure chamber flow into the liquid chamber through the first opening, and the liquid chamber communicate with the circulation flow path for circulating the liquid in the liquid chamber to the liquid tank. According to the liquid ejecting apparatus of this form as well, the contact area between the first slide section and the inner wall surface of the liquid chamber can be reduced, and thus the heat generation due to the friction at the contact area can be reduced. Accordingly, the viscosity of the liquid in the liquid chamber can be suppressed from dropping, and the discharge stability of the liquid discharged through the nozzle hole can be suppressed from dropping.

The invention can also be achieved by various forms other than a liquid ejecting apparatus. For example, the invention can be achieved by forms such as a resistance variable mechanism, a shutter structure, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
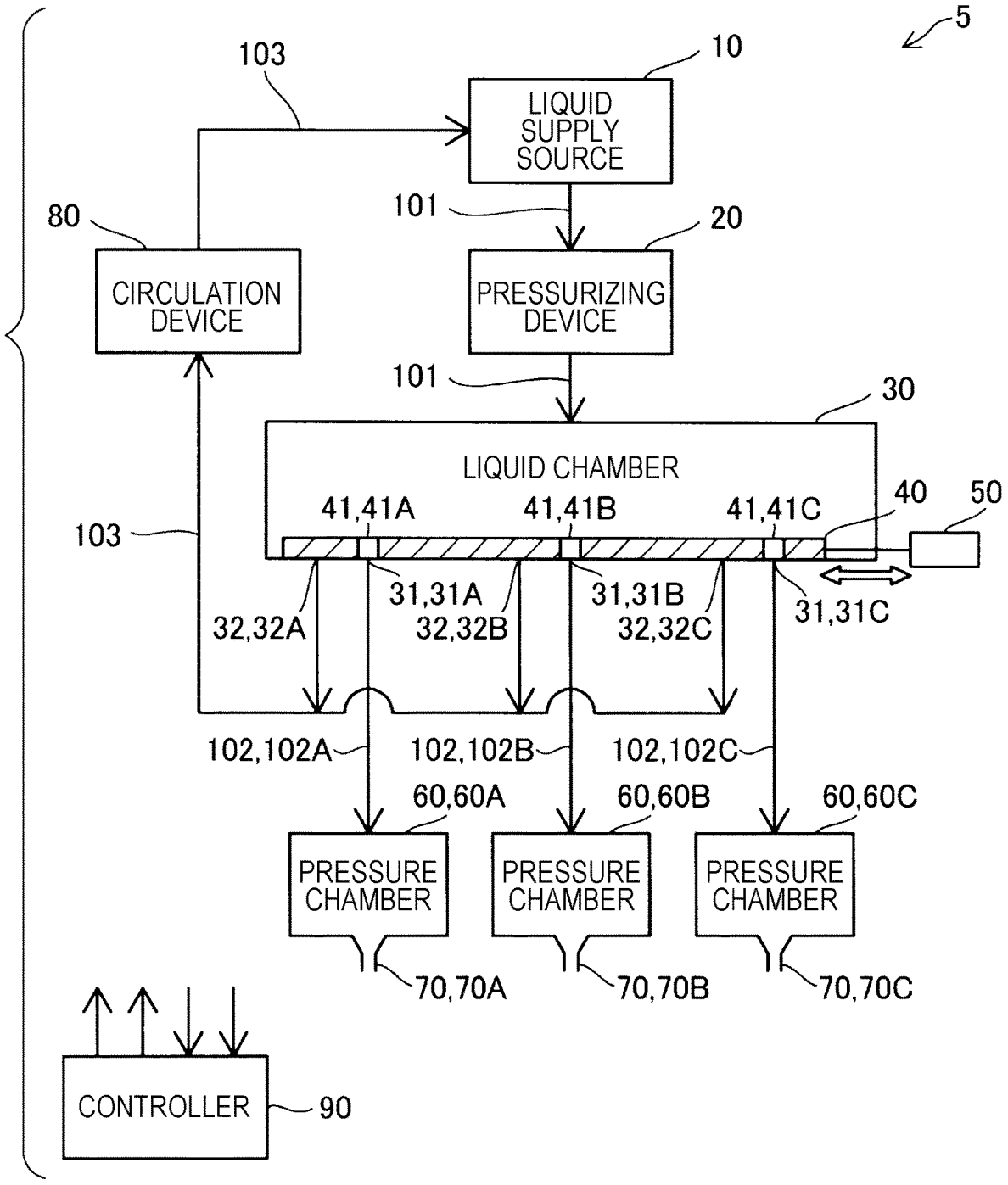
FIG. 1 is a descriptive diagram illustrating an overall configuration of a liquid ejecting apparatus according to a first embodiment.

FIG. 1 is a descriptive diagram illustrating an overall configuration of a liquid ejecting apparatus 5 according to a first embodiment. The liquid ejecting apparatus 5 includes a liquid tank 10, a pressurizing device 20, a liquid chamber 30, a first slide section 40, a driving device 50, a pressure chamber 60, a nozzle hole 70, a circulation device 80, a supply flow path 101, a pressure chamber communication flow path 102, a circulation flow path 103, and a controller 90.

The liquid tank 10 houses a liquid. The liquid tank 10 is, for example, configured of a tank. The pressurizing device 20 is a device for supplying a liquid to the liquid chamber 30 by pressurization. The pressurizing device 20 is, for example, configured of a pump. The liquid in the liquid tank 10 flows into the liquid chamber 30 through the supply flow path 101 by a pressure generated by the pressurizing device 20.

The liquid chamber 30 is connected to a plurality of the pressure chambers 60. On an inner wall surface of the liquid chamber 30, first openings 31 of the number corresponding to the number of the pressure chambers 60 are formed, the pressure chamber communication flow path 102, which communicates with the pressure chamber 60, is connected to each of the first openings 31. The liquid in the liquid chamber 30 flows into the pressure chambers 60 through the pressure chamber communication flow paths 102, respectively, and is discharged through the nozzle holes 70 by a discharge operation sequence, which will be described later. Note that in the embodiment, three pressure chambers 60A, 60B, and 60C are connected to the liquid chamber 30. On the inner wall surface of the liquid chamber 30, three first openings 31A, 31B, and 31C of the number corresponding to the number of the pressure chambers 60 are formed, and pressure chamber communication flow paths 102A, 102B, and 102C, which respectively communicate with the pressure chambers 60A, 60B, and 60C, are connected to the first openings 31A, 31B, and 31C, respectively. The liquid in the liquid chamber 30 flows into the pressure chambers 60A, 60B, and 60C through the pressure chamber communication flow paths 102A, 102B, and 102C, respectively, and discharged through nozzle holes 70A, 70B, and 70C, respectively.

The first slide section 40 is arranged on the inner wall surface of the liquid chamber 30 on which the first openings 31 are formed. The first slide section 40 has first through-holes 41 at positions corresponding to the first openings 31, respectively. The first slide section 40 is driven by the driving device 50 along a predetermined direction. The "predetermined direction" in the embodiment is the same as a longitudinal direction of an internal space of the liquid chamber 30 (left-right direction in FIG. 1), and this direction is also the same as an array direction of the first openings 31. The first slide section 40 slides, by being driven by the driving device 50, on the inner wall surface having the first openings 31 of the liquid chamber 30 along the array direction of the first openings 31, and changes, by changing areas where the first openings 31 and the first through-holes 41 respectively overlap with each other, an opening degree of each of the first openings 31. Note that in the embodiment, the first slide section 40 has first through-holes 41A, 41B, and 41C at positions corresponding to the three first openings 31A, 31B, and 31C, respectively. The first slide section 40 changes, by changing areas where the first openings 31A, 31B, and 31C and the first through-holes 41A, 41B, and 41C respectively overlap with each other, opening degrees of the first openings 31A, 31B, and 31C, respectively.

Additionally, on the inner wall surface of the liquid chamber 30, second openings 32 are formed at positions adjacent to the first openings 31, respectively, and the circulation flow path 103 communicating with the liquid tank 10 is connected to the second openings 32. In the circulation flow path 103, the circulation device 80 is provided. The circulation device 80 is, for example, configured of a pump. The liquid in the liquid chamber 30 circulates through the circulation flow path 103 to the liquid tank 10 by a pressure generated by the circulation device 80. Note that in the embodiment, second openings 32A, 32B, and 32C are formed at positions adjacent to the three first openings 31A, 31B, and 31C, respectively, and the circulation flow path 103 is connected to each thereof.

The controller 90 is configured as a computer including a CPU, a memory, and an interface circuit to which each component is connected. The CPU controls the driving of the driving device 50 by executing a control program stored in the memory. Additionally, in the embodiment, the controller 90 executes the discharge operation sequence for discharging the liquid through the nozzle hole 70 by controlling driving of a pressure chamber actuator 62, which will be described later.

Figure 2:
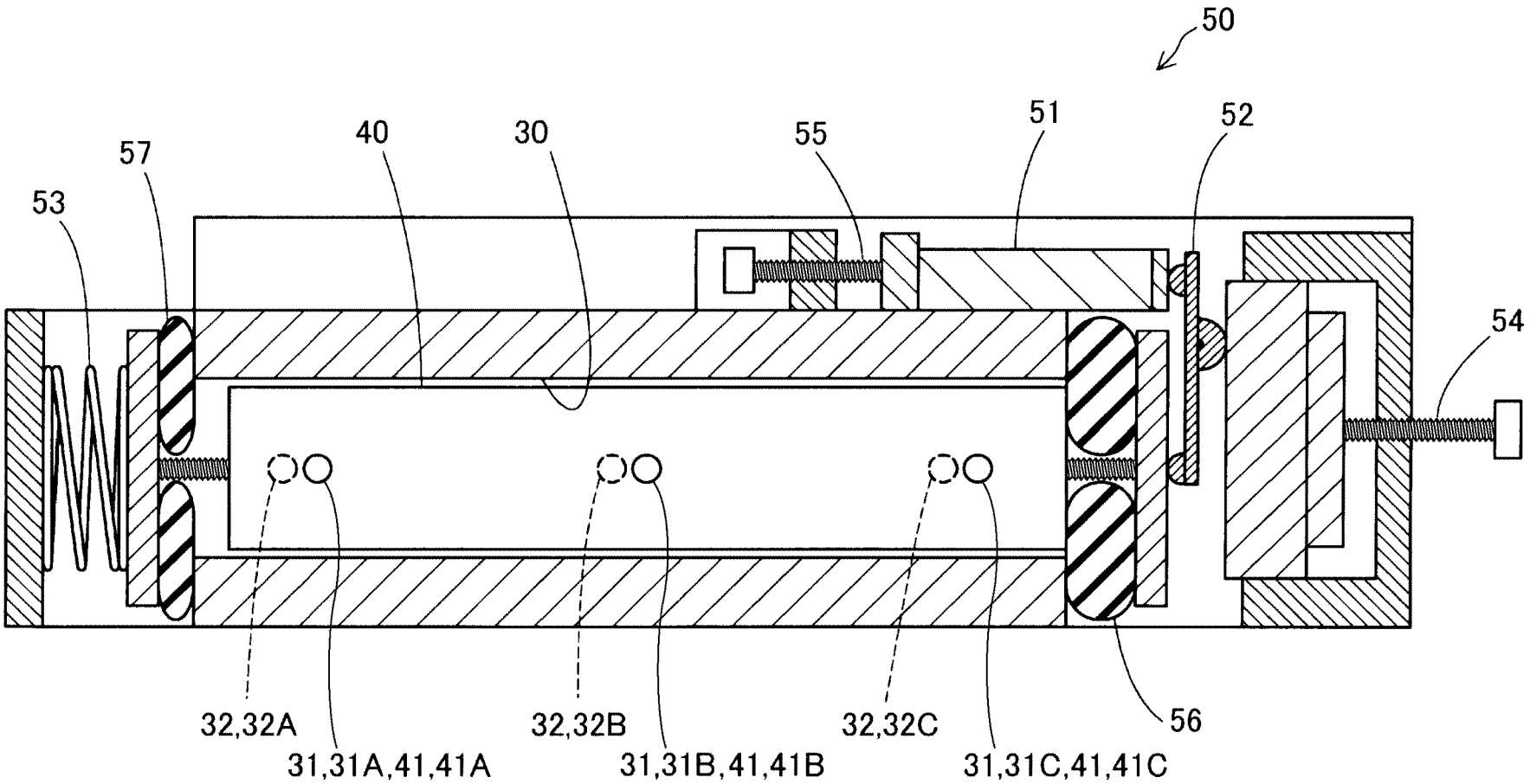
FIG. 2 is a descriptive diagram illustrating a configuration of a first slide section and a driving device according to the first embodiment.

FIG. 2 is a descriptive diagram illustrating a configuration of the first slide section 40 and the driving device 50 according to the first embodiment. Using FIG. 2, a specific configuration of the first slide section 40 arranged in the liquid chamber 30, and the driving device 50 will be described.

In the liquid chamber 30, as described above, the first openings 31A to 31C which communicate with the pressure chambers 60A to 60C, respectively, are formed. At positions adjacent to the first openings 31A to 31C in the liquid chamber 30, the second openings 32A to 32C which communicate with the circulation flow path 103 are formed, respectively. The first openings 31A to 31C are linearly arrayed along the longitudinal direction of the internal space of the liquid chamber 30 at a predetermined interval. The second openings 32A to 32C are linearly arrayed along the longitudinal direction of the internal space of the liquid chamber 30 at the same interval as the array interval of the first openings 31A to 31C.

The first slide section 40 is arranged in the liquid chamber 30, and in the first slide section 40, the first through-holes 41A to 41C are formed. The first through-holes 41A to 41C are linearly arrayed along the longitudinal direction of the internal space of the liquid chamber 30 at the same interval as the array interval of the first openings 31A to 31C.

The driving device 50 is configured of a driving device piezoelectric element 51, a displacement amplifying mechanism 52, an elastic member 53, a first position adjustment mechanism 54, a second position adjustment mechanism 55, a first O-ring 56, and a second O-ring 57. The driving device piezoelectric element 51 expands and contracts in accordance with an applied voltage. The voltage applied to the driving device piezoelectric element 51 is controlled by the controller 90. The displacement amplifying mechanism 52 is configured of a lever, magnifies a displacement of the driving device piezoelectric element 51 due to the expansion and contraction, and presses the first slide section 40 from one end portion side of the first slide section 40. The elastic member 53 is configured of a coil spring, and is arranged on the other end portion side of the first slide section 40 opposite from the displacement amplifying mechanism 52. The first position adjustment mechanism 54 is configured of an adjustment screw, and adjusts a position of the displacement amplifying mechanism 52. The second position adjustment mechanism 55 is configured of an adjustment screw, and adjusts a position of the driving device piezoelectric element 51. The first O-ring 56 and the second O-ring 57 are arranged on end portions of the liquid chamber 30, respectively, and seal the end portions of the liquid chamber 30 such that the liquid in the liquid chamber 30 does not leak to the outside.

Figure 3:
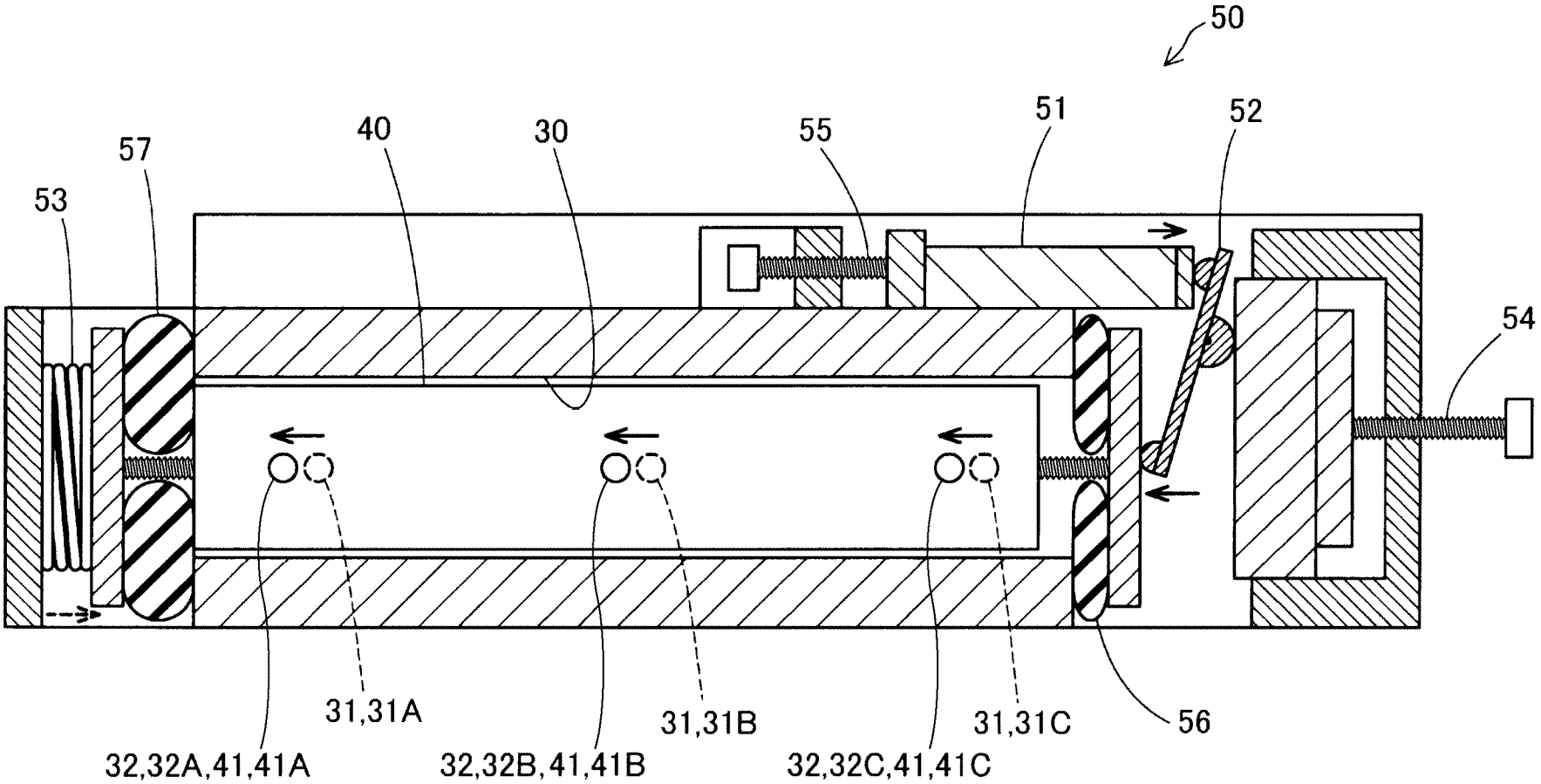
FIG. 3 is a descriptive diagram illustrating an operation of the first slide section and the driving device according to the first embodiment.

FIG. 3 is a descriptive diagram illustrating an operation of the first slide section 40 and the driving device 50 according to the first embodiment. Using FIG. 2 and FIG. 3, an operation in which the first slide section 40 is driven by the driving device 50 will be described. In FIG. 2, the first slide section 40 is arranged at a position where the first through-holes 41A to 41C and the first openings 31A to 31C respectively overlap with each other when viewed from a direction perpendicular to the depiction in the drawing. In this state, the first openings 31A to 31C are each in an open state, and the liquid chamber 30 and the pressure chambers 60A to 60C are in a communication state. The second openings 32A to 32C are each in a closed state, and the liquid chamber 30 and the circulation flow path 103 are in a non-communication state. When the driving device piezoelectric element 51 expands, a displacement of the driving device piezoelectric element 51 is magnified by the displacement amplifying mechanism 52, and transmitted to the first slide section 40. The first slide section 40 is pressed by the displacement amplifying mechanism 52 toward a left direction in FIG. 2, and slides along the inner wall surface of the liquid chamber 30 to a position illustrated in FIG. 3.

In FIG. 3, the first slide section 40 has moved to a position where the first through-holes 41A to 41C and the second openings 32A to 32C respectively overlap with each other when viewed from the direction perpendicular to the depiction in the drawing. In this state, the second openings 32A to 32C are each in an open state, and the liquid chamber 30 and the circulation flow path 103 are in a communication state. The first openings 31A to 31C are each in a closed state, and the liquid chamber 30 and the pressure chambers 60A to 60C are in a non-communication state. Additionally, the elastic member 53 contracts by being pressed by the driving device piezoelectric element 51 through the first slide section 40 and the displacement amplifying mechanism 52. Accordingly, a force pressed back by the elastic member 53 acts on the first slide section 40, and when the driving device piezoelectric element 51 contracts, the first slide section 40 is pressed back toward a right direction in FIG. 3, and slides along the inner wall surface of the liquid chamber 30 to the position illustrated in FIG. 2.

Figure 4:
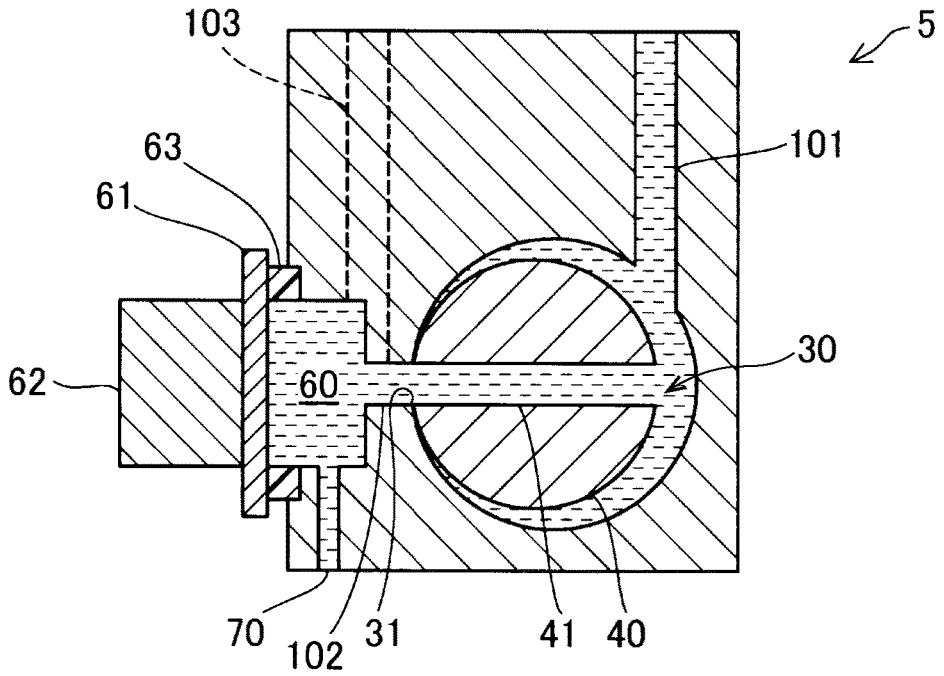
FIG. 4 is a schematic cross-sectional view illustrating a cross-section of a liquid chamber and a pressure chamber according to the first embodiment.
Figure 5:
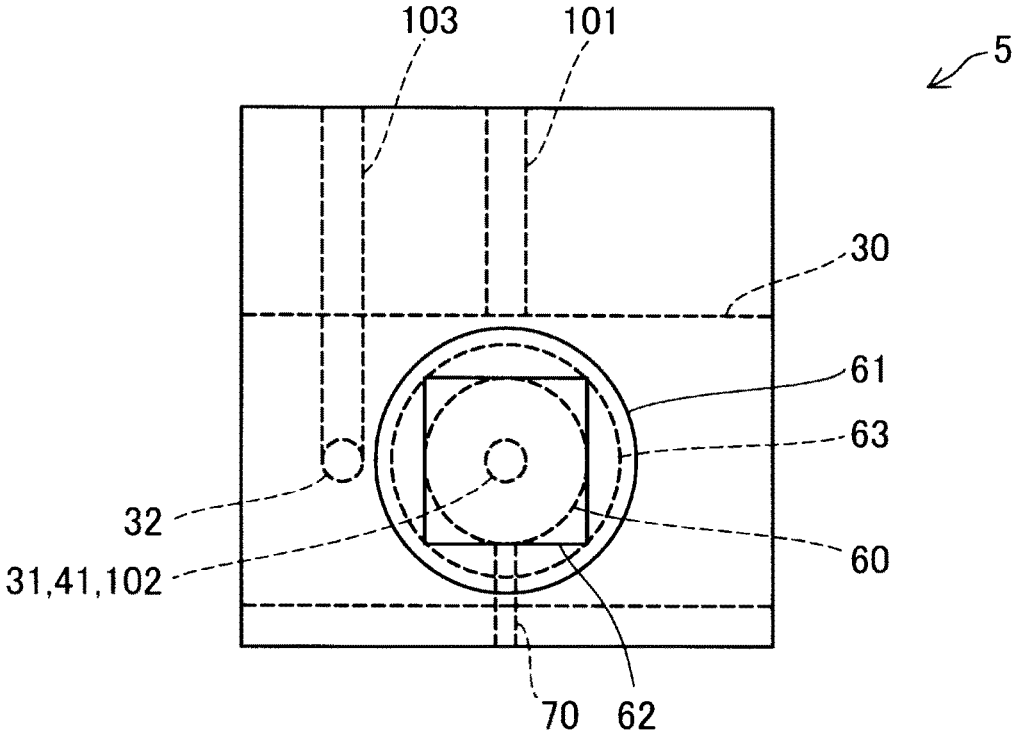
FIG. 5 is a front view illustrating a configuration of the liquid chamber and the pressure chamber according to the first embodiment.
Figure 6:
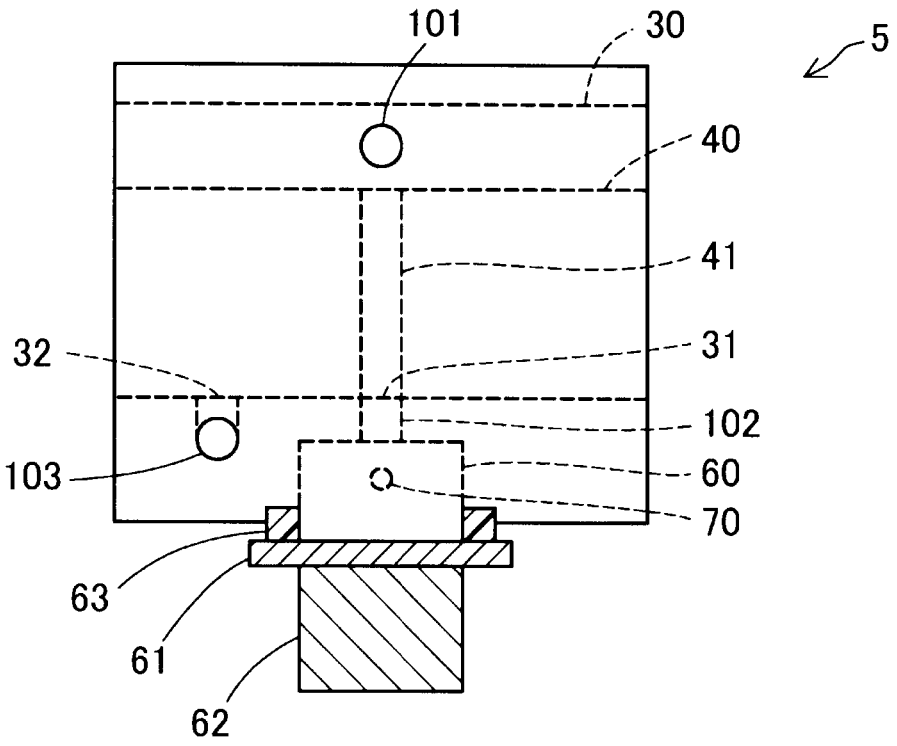
FIG. 6 is a top view illustrating the configuration of the liquid chamber and the pressure chamber according to the first embodiment.

FIG. 4 is a schematic cross-sectional view illustrating a cross-section of the liquid chamber 30 and the pressure chamber 60 according to the first embodiment. FIG. 5 is a front view illustrating a configuration of the liquid chamber 30 and the pressure chamber 60 according to the first embodiment. FIG. 6 is a top view illustrating the configuration of the liquid chamber 30 and the pressure chamber 60 according to the first embodiment. Using FIG. 4 to FIG. 6, a specific configuration of the liquid chamber 30 and the pressure chamber 60 will be described. Note that FIG. 4 to FIG. 6 illustrate only one pressure chamber 60, but, in the embodiment, other pressure chambers 60 also have the same configuration.

Using FIG. 4, a configuration of the liquid chamber 30 will be described. The liquid chamber 30 has a column-shaped internal space. In FIG. 4, the liquid chamber 30 is illustrated so as to have a circular shaped internal space, and has a space across a direction perpendicular to the depiction in FIG. 4. The supply flow path 101 is connected to the liquid chamber 30, and the liquid supplied from the liquid tank 10 flows into the liquid chamber 30. On the inner wall surface of the liquid chamber 30 on the pressure chamber 60 side, the first openings 31 that communicate with the pressure chamber 60 are formed. Note that a diameter of each of the first openings 31 is, for example, approximately 100 to 300 μm.

In the liquid chamber 30, as described above, the first slide section 40 is arranged, and the first slide section 40 has the first through-holes 41 at positions corresponding to the first openings 31, respectively. The first slide section 40 in the embodiment has a columnar shape, a diameter of the first slide section 40 is smaller than a diameter of the internal space of the liquid chamber 30. Additionally, an axial direction of the column of the first slide section 40 is parallel to an axial direction of the column of the liquid chamber 30, the first slide section 40 is in contact with the inner wall surface having the first openings 31 of the liquid chamber 30. Accordingly, the first slide section 40 is in linear contact with the inner wall surface having the first openings 31 of the liquid chamber 30 along the array direction of the first openings 31. Note that in the specification, "linear contact" refers to contact at a width equal to or smaller than the diameter of the first opening 31 (100 to 300 μm). Note that the first opening 31 and the first through-hole 41 may communicate with each other with a small gap. In this case, it is preferable that a flow path resistance at the gap be made larger than a flow path resistance at the first opening 31 such that the liquid flows not into the gap but into the first opening 31.

The pressure chamber 60 communicates with the nozzle hole 70 through which the liquid is discharged. On one wall surface of the pressure chamber 60, a vibration plate 61 is attached with an elastic bushing 63 interposed therebetween, and the pressure chamber actuator 62 is attached to the vibration plate 61. The pressure chamber actuator 62 is, for example, configured of a piezoelectric element, and expands and contracts in accordance with an applied voltage. A voltage applied to the pressure chamber actuator 62 is controlled by the controller 90. When the pressure chamber actuator 62 expands, the vibration plate 61 is pressed and a capacity in the pressure chamber 60 decreases. When the pressure chamber actuator 62 contracts, the vibration plate 61 is pulled and the capacity in the pressure chamber 60 increases. In accordance with the change in the capacity in the pressure chamber 60, a pressure in the pressure chamber 60 changes. When the pressure in the pressure chamber 60 exceeds a maximum pressure at which the meniscus of the nozzle hole 70 is not broken, the liquid is discharged through the nozzle hole 70.

Using FIG. 5, arrangement of the second openings 32 will be described. On the inner wall surface of the liquid chamber 30, the second openings 32 communicating with the circulation flow path 103 for circulating the liquid in the liquid chamber 30 to the liquid tank 10 are formed. The second openings 32 are respectively formed at positions adjacent to the first openings 31 along the array direction of the first openings 31.

Using FIG. 6, a positional relationship among the first through-hole 41 of the first slide section 40, the first opening 31, and the second opening 32 will be described. The driving device 50 drives, as described above, the first slide section 40 along the array direction of the first openings 31. The first slide section 40 slides, by being driven by the driving device 50, on the inner wall surface having the first openings 31 of the liquid chamber 30 along the array direction of the first openings 31, and changes, by changing areas where the first openings 31 and the first through-holes 41 respectively overlap with each other, an opening degree of each of the first openings 31. Additionally, in the same manner, the first slide section 40 changes, by changing areas where the second openings 32 and the first through-holes 41 respectively overlap with each other, an opening degree of each of the second openings 32. By the first slide section 40 changing the opening degree of each of the first openings 31, a flow path resistance between the liquid chamber 30 and the pressure chamber 60 is changed. Additionally, by the first slide section 40 changing the opening degree of each of the second openings 32, a flow path resistance between the liquid chamber 30 and the circulation flow path 103 is changed.

Figure 7:
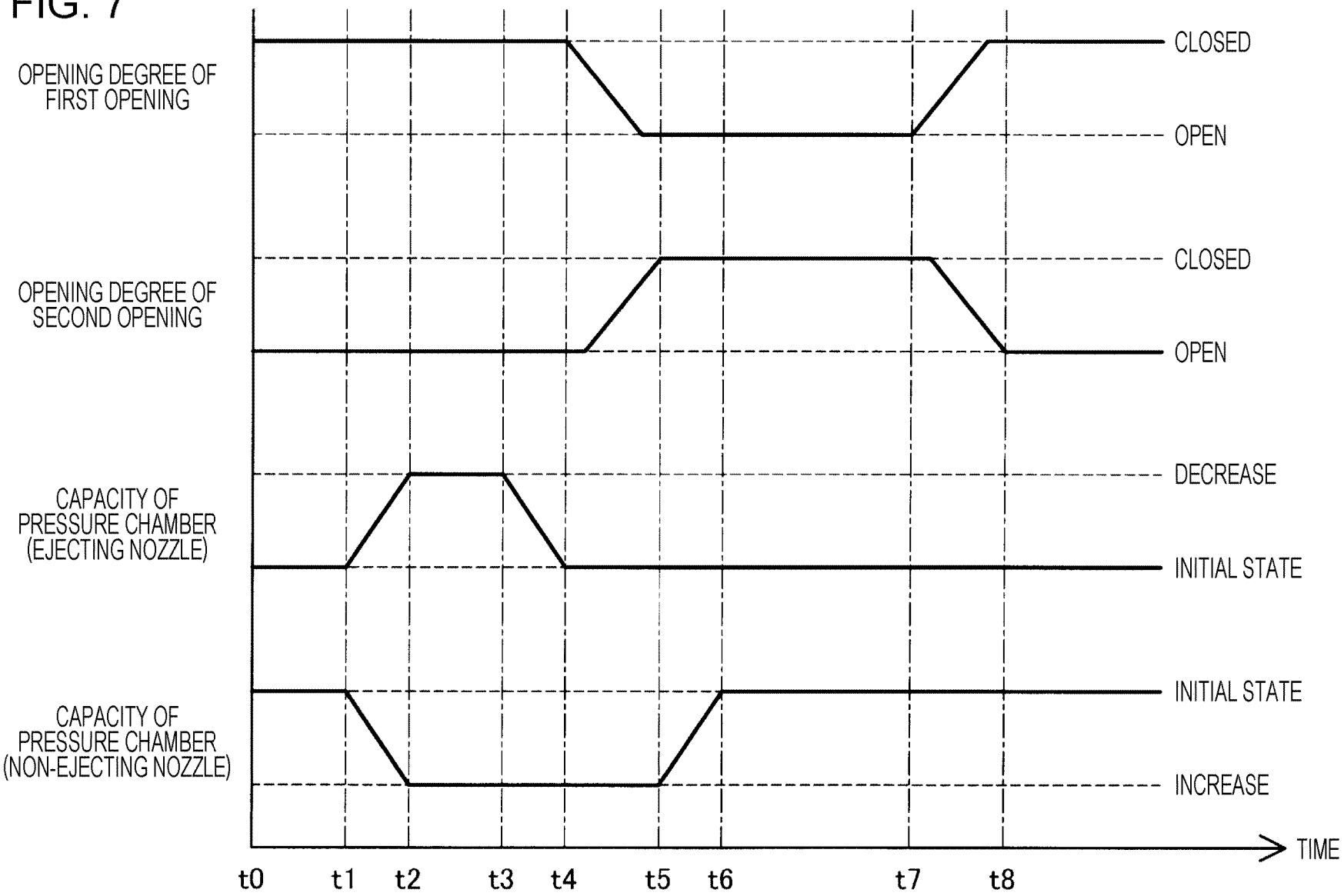
FIG. 7 is a timing chart illustrating a discharge operation sequence of a liquid through a nozzle hole.

FIG. 7 is a timing chart illustrating an example of the discharge operation sequence of the liquid through the nozzle hole 70, which is executed by the controller 90 controlling the pressure chamber actuator 62 and the driving device piezoelectric element 51 of the driving device 50. A horizontal axis represents time in one cycle of the discharge operation. A vertical axis represents the opening degree of the first opening 31, a capacity of the pressure chamber 60 of an ejecting nozzle, and a capacity of the pressure chamber 60 of a non-ejecting nozzle. Here, the "ejecting nozzle" refers to the nozzle hole 70 through which the liquid is discharged in the cycle. Additionally, the "non-ejecting nozzle" refers to the nozzle hole 70 through which the liquid is not discharged in the cycle. Whether to be the ejecting nozzle or the non-ejecting nozzle in the cycle is controlled in accordance with a printing pattern.

First, a relationship between the capacity in the pressure chamber 60 of the ejecting nozzle and the opening degree of the first opening 31 will be described. At a time t0 which is in an initial state, the pressure chamber 60 of the ejecting nozzle is filled with the liquid. At this time, the first opening 31 is in the closed state. During a time t1 to a time t2, the capacity in the pressure chamber 60 of the ejecting nozzle is decreased. During the time t2 to a time t3, the capacity in the pressure chamber 60 of the ejecting nozzle is decreased to a predetermined capacity, and a pressure in the pressure chamber 60 exceeds the maximum pressure at which the meniscus of the nozzle hole 70 is not broken. With this, the liquid is discharged through the nozzle hole 70. During the time t3 to a time t4, the capacity in the pressure chamber 60 of the ejecting nozzle is returned to the initial state. During the time t4 to a time t5, the first slide section 40 is driven, and the opening degree of the first opening 31 is gradually increased. During the time t5 to a time t7, the first opening 31 is opened to a predetermined opening degree, the liquid is supplied in the pressure chamber 60 from the liquid chamber 30. During the time t7 to a time t8, the first slide section 40 is driven, and the opening degree of the first opening 31 is gradually decreased. At the time t8, the first opening 31 is made to be in the closed state again, and the one cycle ends.

Next, a relationship between the capacity in the pressure chamber 60 of the non-ejecting nozzle and the opening degree of the first opening 31 will be described. At the time t0 which is in the initial state, the pressure chamber 60 of the non-ejecting nozzle is filled with the liquid. At this time, the first opening 31 is in the closed state. In the liquid ejecting apparatus 5 according to the embodiment, since all the first openings 31 are opened and closed by one first slide section 40, regardless of being the ejecting nozzle or the non-ejecting nozzle, during the time t4 to the time t5, the first slide section 40 is driven, and the opening degree of the first opening 31 is gradually increased. Additionally, since the liquid is not discharged through the non-ejecting nozzle, the pressure chamber 60 of the non-ejecting nozzle is filled with the liquid. Therefore, in a case where the first opening 31 is made to be the open state while the capacity in the pressure chamber 60 of the non-ejecting nozzle remains in the initial state, the liquid is further supplied in the pressure chamber 60 of the non-ejecting nozzle which is filled with the liquid, and there is a possibility that the liquid leaks through the nozzle hole 70. Accordingly, prior to the first opening 31 being made to be in the open state, during the time t1 to the time t2, the capacity in the pressure chamber 60 of the non-ejecting nozzle is increased. Thereafter, from the time t5 after the first opening 31 becomes the open state to a time t6, the capacity in the pressure chamber 60 of the non-ejecting nozzle is returned to the initial state. With this, the liquid in the pressure chamber 60 of the non-ejecting nozzle is transmitted to the liquid chamber 30 through the first opening 31, and the liquid is suppressed from leaking through the nozzle hole 70. During the time t7 to the time t8, the first slide section 40 is driven, and the opening degree of the first opening 31 is gradually decreased. At the time t8, the first opening 31 is made to be in the closed state again, and the one cycle ends.

Note that in the embodiment, in a case where the first opening 31 is in the open state, the second opening 32 is in the closed state. In other words, in a case where the liquid chamber 30 communicates with the pressure chamber 60, the liquid chamber 30 does not communicate with the circulation flow path 103. Additionally, in a case where the second opening 32 is in the open state, the first opening 31 is in the closed state. In other words, in a case where the liquid chamber 30 communicates with the circulation flow path 103, the liquid chamber 30 does not communicate with the pressure chamber 60.

By the liquid ejecting apparatus 5 according to the embodiment described above, since the first slide section 40 and the inner wall surface of the liquid chamber 30 make linear contact with each other, in comparison with a case where the first slide section 40 and the inner wall surface of the liquid chamber 30 make surface contact with each other, a contact area between the first slide section 40 and the inner wall surface of the liquid chamber 30 can be reduced, and heat generation due to friction at the contact area can be reduced. Accordingly, the viscosity of the liquid in the liquid chamber 30 can be suppressed from dropping, and the discharge stability of the liquid discharged through the nozzle hole 70 can be suppressed from dropping.

Additionally, in the embodiment, the plurality of first openings 31 can be opened or closed by the one first slide section 40 and the driving device 50, and thus, in comparison with a case where the first slide section 40 and the driving device 50 are individually provided for each of the plurality of first openings 31, the liquid ejecting apparatus 5 can be reduced in size.

B. Second Embodiment

Figure 8:
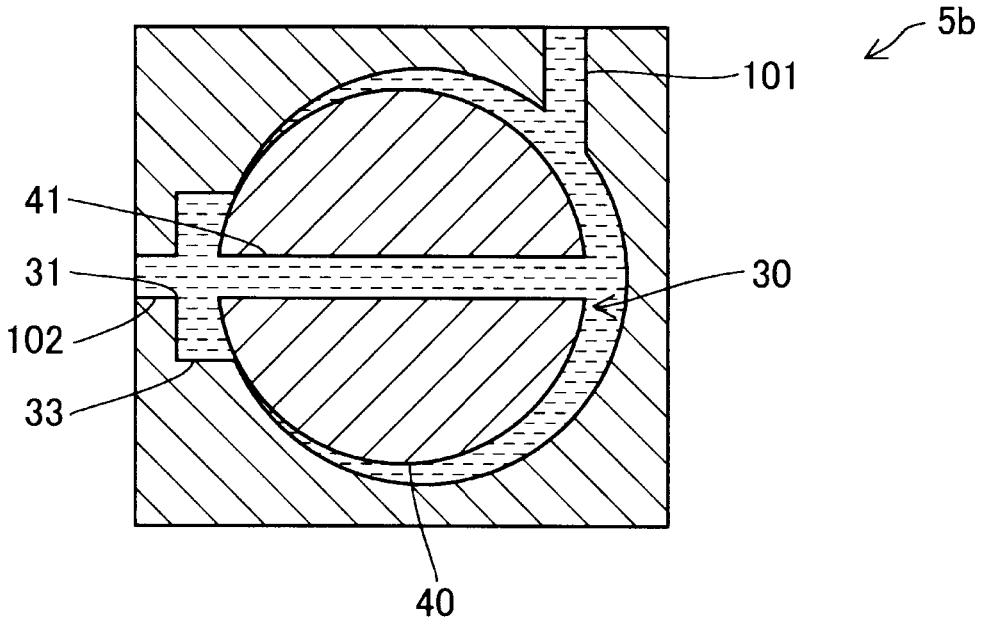
FIG. 8 is a schematic cross-sectional view illustrating a first opening according to a second embodiment.

FIG. 8 is a schematic cross-sectional view illustrating the first opening 31 of a liquid ejecting apparatus 5*b* according to a second embodiment. In the following descriptions, constituent elements that have the same functions as those of the first embodiment will be described using the same reference numerals. The liquid ejecting apparatus 5*b* according to the second embodiment is different from that in the first embodiment (FIG. 4) in points that the inner wall surface of the liquid chamber 30 has a groove-shaped recessed portion 33 that extends along the longitudinal direction of the internal space of the liquid chamber 30, and the first openings 31 are formed in the recessed portion 33. In the embodiment, the first slide section 40 and the inner wall surface of the liquid chamber 30 make linear contact with each other at a corner portion of the recessed portion 33.

According to the liquid ejecting apparatus 5*b* of this form, the first slide section 40 is driven so as to be guided by the groove-shaped recessed portion 33 provided in the liquid chamber 30, and thus positioning accuracy of the first slide section 40 in the liquid chamber 30 can be improved. Note that there is a gap between the first opening 31 and the first slide section 40, but the gap has a larger flow path resistance than those of the first opening 31, the first through-hole 41, and the second opening 32, and thus there is no problem of so called crosstalk.

C. Third Embodiment

Figure 9:
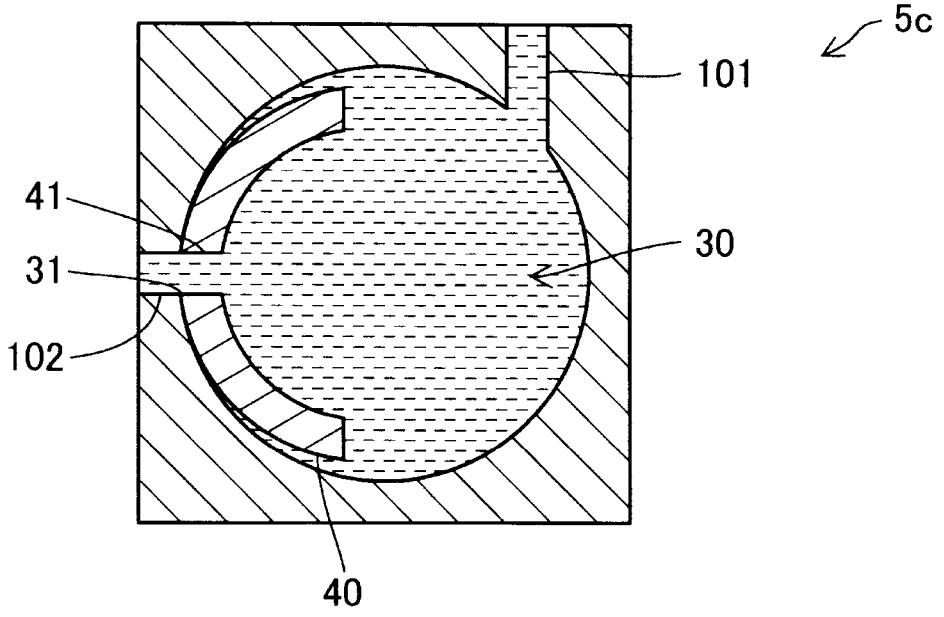
FIG. 9 is a schematic cross-sectional view illustrating a cross-sectional shape of the first slide section according to a third embodiment.

FIG. 9 is a schematic cross-sectional view of the first slide section 40 of a liquid ejecting apparatus 5*c* according to a third embodiment. The liquid ejecting apparatus 5*c* according to the third embodiment is different from that in the first embodiment (FIG. 4) in a point that a cross-section of the first slide section 40 perpendicular to the longitudinal direction has a circular arc shape.

According to the liquid ejecting apparatus 5*c* of this form, a volume of the first slide section 40 can be made smaller than that in a case where the first slide section 40 is formed in a column with the same diameter, and thus a capacity of the liquid chamber 30 can be secured, the liquid chamber 30 can be reduced in size.

D. Fourth Embodiment

Figure 10:
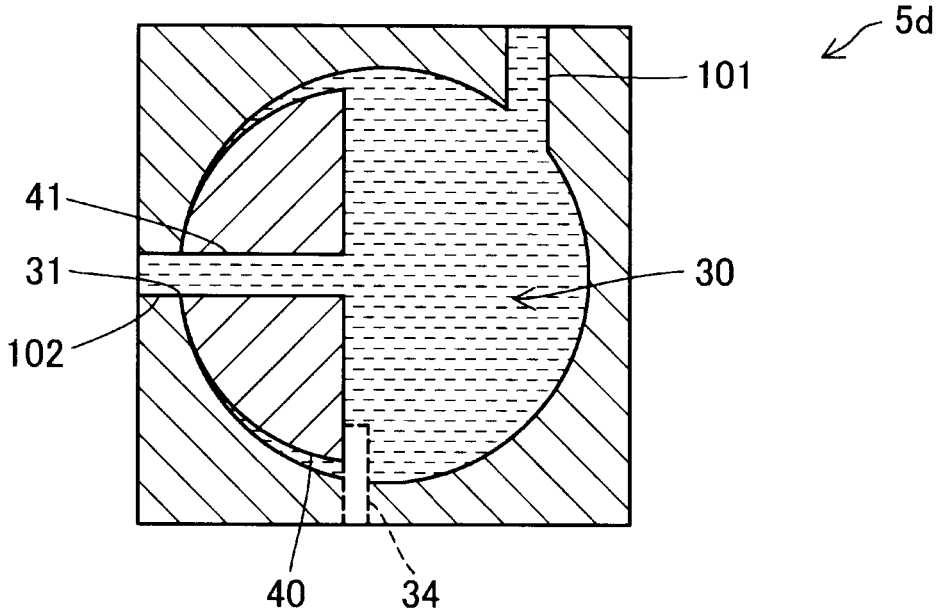
FIG. 10 is a schematic cross-sectional view illustrating the cross-sectional shape of the first slide section according to a fourth embodiment.

FIG. 10 is a schematic cross-sectional view of the first slide section 40 of a liquid ejecting apparatus 5*d* according to a fourth embodiment. The liquid ejecting apparatus 5*d* according to the fourth embodiment is different from that in the first embodiment (FIG. 4) in a point that a surface of the first slide section 40 on an opposite side from the side on which the first slide section 40 makes linear contact with the inner wall surface of the liquid chamber 30 is a flat surface. Specifically, the first slide section 40 has a shape in which a column is divided by a cross-section parallel to the axial direction of the column. Additionally, a pin 34 projecting from the liquid chamber 30 makes contact with part of a flat surface portion of the first slide section 40. The flat surface portion of the first slide section 40 and the pin 34 configure a rotation suppressing mechanism for suppressing the first slide section 40 from rotating around an axis parallel to the longitudinal direction of the first slide section 40 as a rotational axis.

According to the liquid ejecting apparatus 5*d* of this form, the first slide section 40 is suppressed from rotating around the axis parallel to the longitudinal direction of the first slide section 40 as the rotational axis, and thus the positioning accuracy of the first slide section 40 in the liquid chamber 30 can be improved.

E. Fifth Embodiment

Figure 11:
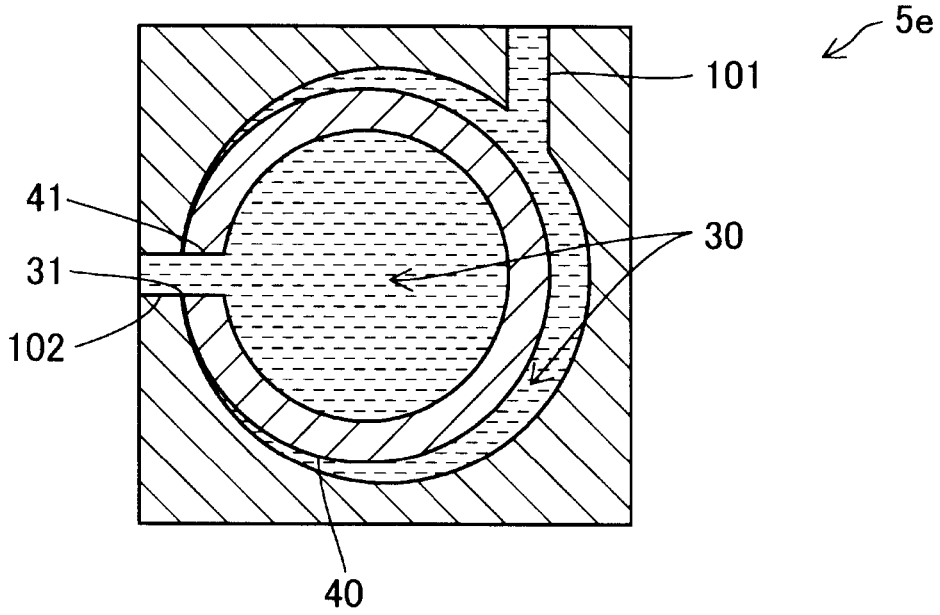
FIG. 11 is a schematic cross-sectional view illustrating the cross-sectional shape of the first slide section according to a fifth embodiment.

FIG. 11 is a schematic cross-sectional view of the first slide section 40 of a liquid ejecting apparatus 5*e* according to a fifth embodiment. The liquid ejecting apparatus 5*e* according to the fifth embodiment is different from that in the first embodiment (FIG. 4) in points that a cross-section of the first slide section 40 perpendicular to the longitudinal direction has a hollow, and the internal space of the hollow of the first slide section 40 forms part of the liquid chamber 30. Specifically, the first slide section 40 has a pipe shape in which at least one end portion is opened, and the liquid in the liquid chamber 30 flows into the first slide section 40 from the opened end portion of the first slide section 40. The liquid in the first slide section 40 flows into the pressure chamber 60 or the circulation flow path 103 through the first through-hole 41.

According to the liquid ejecting apparatus 5*e* of this form, the part of the liquid chamber 30 can be provided in the inside of the first slide section 40, and thus the liquid chamber 30 can be reduced in size. Note that the end portions of the first slide section 40 may not be opened, and a through-hole may be formed on a side surface of the first slide section 40. In this case, the liquid in the liquid chamber 30 flows into the first slide section 40 through the through-hole.

F. Sixth Embodiment

Figure 12:
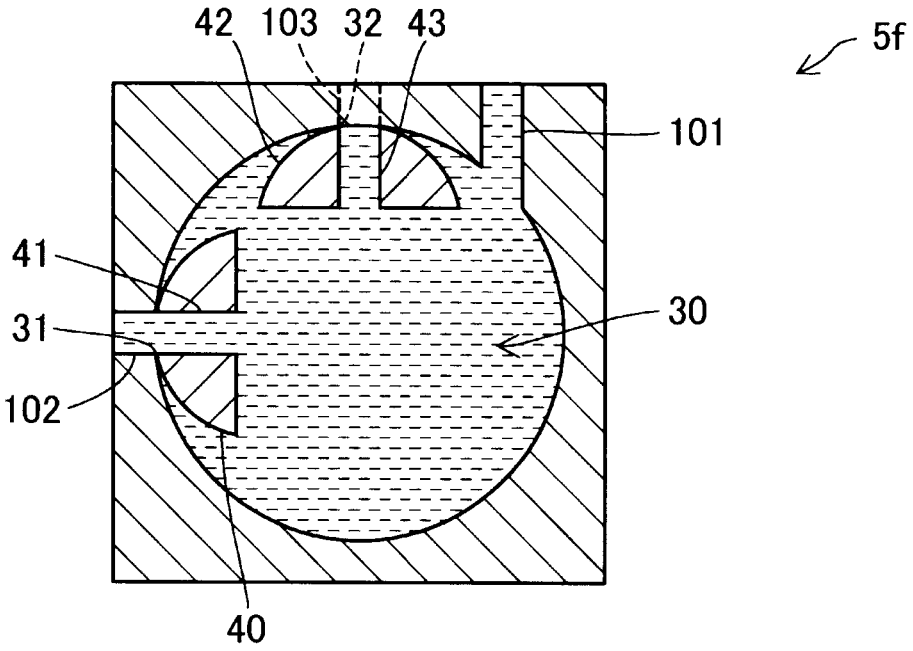
FIG. 12 is a schematic cross-sectional view illustrating a cross-sectional shape of each slide section according to a sixth embodiment.

FIG. 12 is a schematic cross-sectional view of the first slide section 40 and a second slide section 42 of a liquid ejecting apparatus 5*f* according to a sixth embodiment. The liquid ejecting apparatus 5*f* according to the sixth embodiment is different from that in the first embodiment (FIG. 4) in a point of an arrangement of the second opening 32 in the liquid chamber 30. Additionally, the embodiment is different from the first embodiment (FIG. 4) in a point that the second slide section 42 having a second through-hole 43 is arranged at a position corresponding to the second opening 32 in the liquid chamber 30. Specifically, the second opening 32 is not formed side by side with the first opening 31 on the straight line where the first slide section 40 and the liquid chamber 30 make linear contact with each other (a direction perpendicular to the depiction in FIG. 12), but is formed at an upper portion of the liquid chamber 30. The second slide section 42 slides, by being driven by the driving device 50, on the inner wall surface having the second openings 32 of the liquid chamber 30 along the longitudinal direction of the internal space of the liquid chamber 30, and changes, by changing areas where the second openings 32 and the second through-holes 43 respectively overlap with each other, an opening degree of each of the second openings 32. The second slide section 42 makes linear contact with the inner wall surface having the second openings 32 of the liquid chamber 30 along the longitudinal direction of the internal space of the liquid chamber 30.

According to the liquid ejecting apparatus 5*f* of this form, the contact area between the second slide section 42 and the inner wall surface of the liquid chamber 30 can be reduced, and thus the heat generation due to the friction at the contact area can be reduced. Accordingly, in a case where the second slide section 42 for opening or closing the second opening 32 communicating with the circulation flow path 103 is provided in the liquid chamber 30 as well, the viscosity of the liquid in the liquid chamber 30 can be suppressed from dropping, and the discharge stability of the liquid discharged through the nozzle hole 70 can be suppressed from dropping. Additionally, in the liquid chamber 30, the first opening 31 and the second opening 32 are not arranged on the same straight line, and thus the interval between the first openings 31 can be reduced. Accordingly, the interval between the nozzle holes 70 can be reduced, and the nozzle holes 70 can be disposed more densely. Note that the driving device 50 for driving the second slide section 42 may be integrally provided with the driving device 50 for driving the first slide section 40, or may be provided separately from the driving device 50 for driving the first slide section 40.

G. Seventh Embodiment

Figure 13:
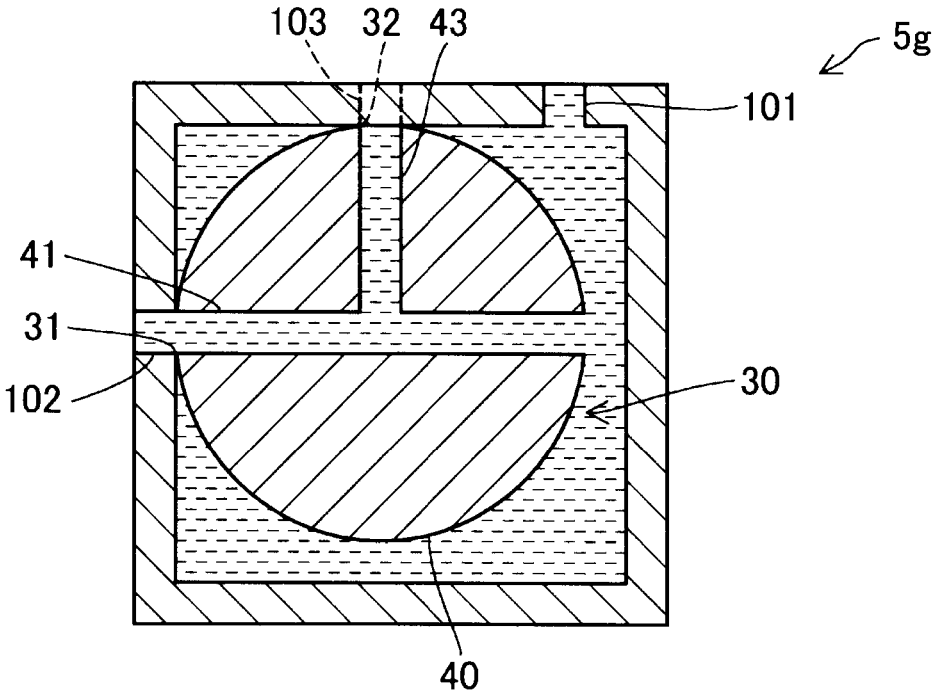
FIG. 13 is a schematic cross-sectional view illustrating the cross-sectional shape of the first slide section according to a seventh embodiment.

FIG. 13 is a schematic cross-sectional view of the first slide section 40 of a liquid ejecting apparatus 5*g* according to a seventh embodiment. The liquid ejecting apparatus 5*g* according to the seventh embodiment is different from that in the sixth embodiment (FIG. 12) in a point that the first slide section 40 and the second slide section 42 are integrally formed. Additionally, the embodiment is also different from the sixth embodiment (FIG. 12) in a point that the internal space of the liquid chamber 30 does not have the columnar shape, but has a quadrangular prism shape. Specifically, the first slide section 40 (the second slide section 42) has a columnar shape. The first slide section 40 has the first through-hole 41 at a position corresponding to the first opening 31, and has the second through-hole 43 at a position corresponding to the second opening 32. An opening degree of each of the first opening 31 and the second opening 32 is changed by the first slide section 40 being driven. Additionally, since the first slide section 40 has the columnar shape, whereas the internal space of the liquid chamber 30 has the quadrangular prism shape, the first slide section 40 makes linear contact with the inner wall surface having the first opening 31 of the liquid chamber 30 along the longitudinal direction of the internal space of the liquid chamber 30, and makes linear contact with the inner wall surface having the second opening 32 of the liquid chamber 30 along the longitudinal direction of the internal space of the liquid chamber 30.

According to the liquid ejecting apparatus 5*g* of this form, the first opening 31 communicating with the pressure chamber 60 and the second opening 32 communicating with the circulation flow path 103 can be opened or closed by a pair of the first slide section 40 and the driving device 50, and thus the liquid ejecting apparatus 5*g* can be reduced in size.

H. Eighth Embodiment

Figure 14:
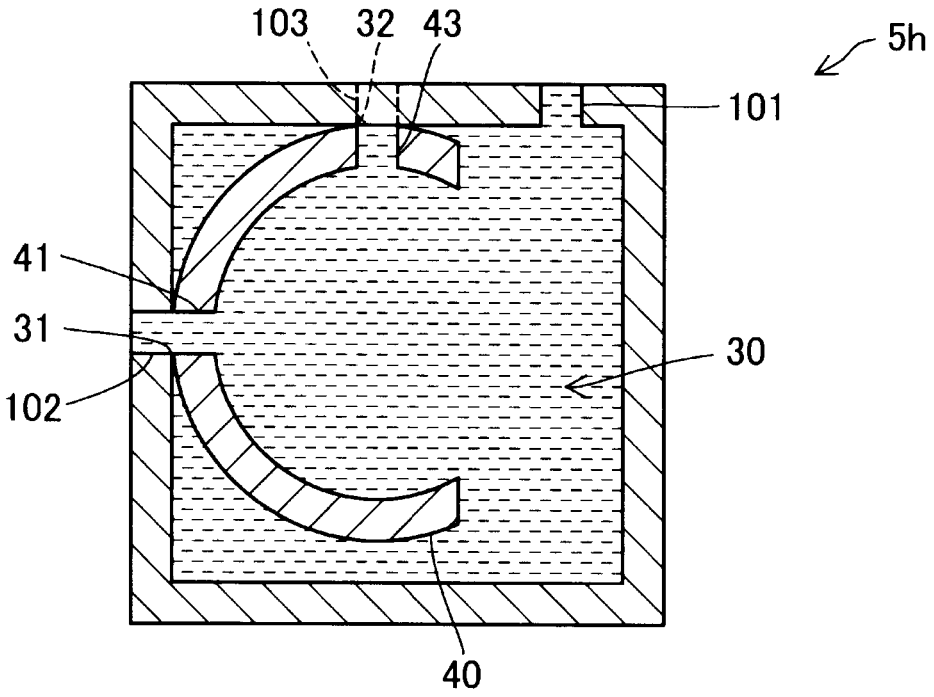
FIG. 14 is a schematic cross-sectional view illustrating the cross-sectional shape of the first slide section according to an eighth embodiment.

FIG. 14 is a schematic cross-sectional view of the first slide section 40 of a liquid ejecting apparatus 5*h* according to an eighth embodiment. The liquid ejecting apparatus 5*h* according to the eighth embodiment is different from that in the seventh embodiment (FIG. 13) in a point that a cross-section of the first slide section 40 perpendicular to the longitudinal direction has a circular arc shape.

According to the liquid ejecting apparatus 5*h* of this form, a volume of the first slide section 40 can be made smaller than that in a case where the first slide section 40 is formed in a column with the same diameter, and thus a capacity of the liquid chamber 30 can be secured, and the liquid chamber 30 can be reduced in size.

I. Ninth Embodiment

Figure 15:
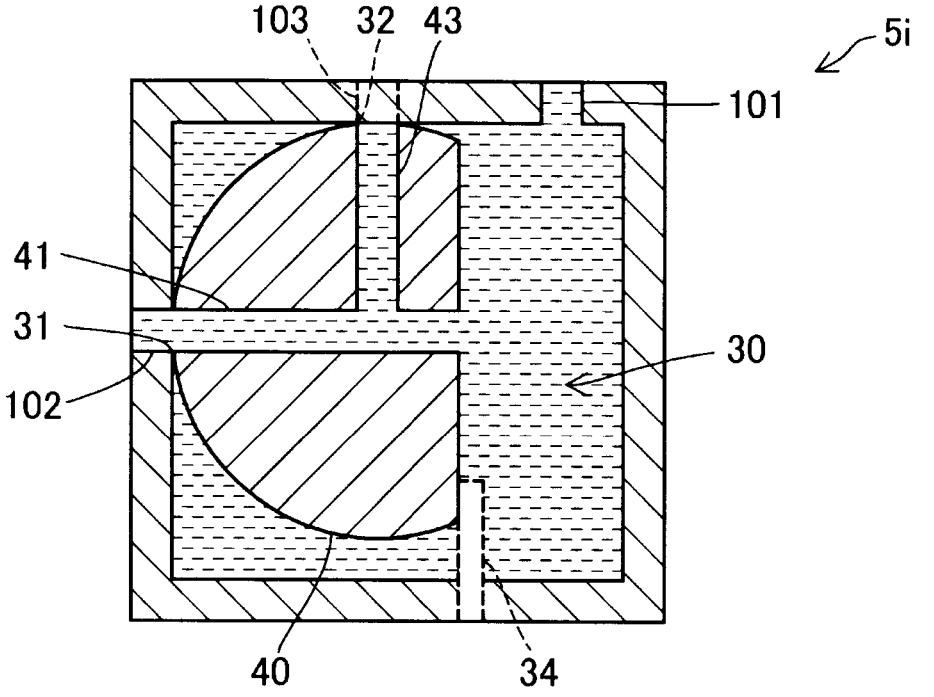
FIG. 15 is a schematic cross-sectional view illustrating the cross-sectional shape of the first slide section according to a ninth embodiment.

FIG. 15 is a schematic cross-sectional view of the first slide section 40 of a liquid ejecting apparatus 5*i* according to a ninth embodiment. The liquid ejecting apparatus 5*i* according to the ninth embodiment is different from that in the seventh embodiment (FIG. 13) in a point that a surface of the first slide section 40 on an opposite side from the side on which the first slide section 40 makes linear contact with the inner wall surface of the liquid chamber 30 is a flat surface. Specifically, the first slide section 40 has a shape in which a column is divided by a cross-section parallel to the axial direction of the column. Additionally, the pin 34 projecting from the liquid chamber 30 makes contact with part of a flat surface portion of the first slide section 40. The flat surface portion of the first slide section 40 and the pin 34 configure a rotation suppressing mechanism for suppressing the first slide section 40 from rotating around an axis parallel to the longitudinal direction of the first slide section 40 as a rotational axis.

According to the liquid ejecting apparatus 5*i* of this form, the first slide section 40 is suppressed from rotating around the axis parallel to the longitudinal direction of the first slide section 40 as the rotational axis, and thus the positioning accuracy of the first slide section 40 in the liquid chamber 30 can be improved.

J. Tenth Embodiment

Figure 16:
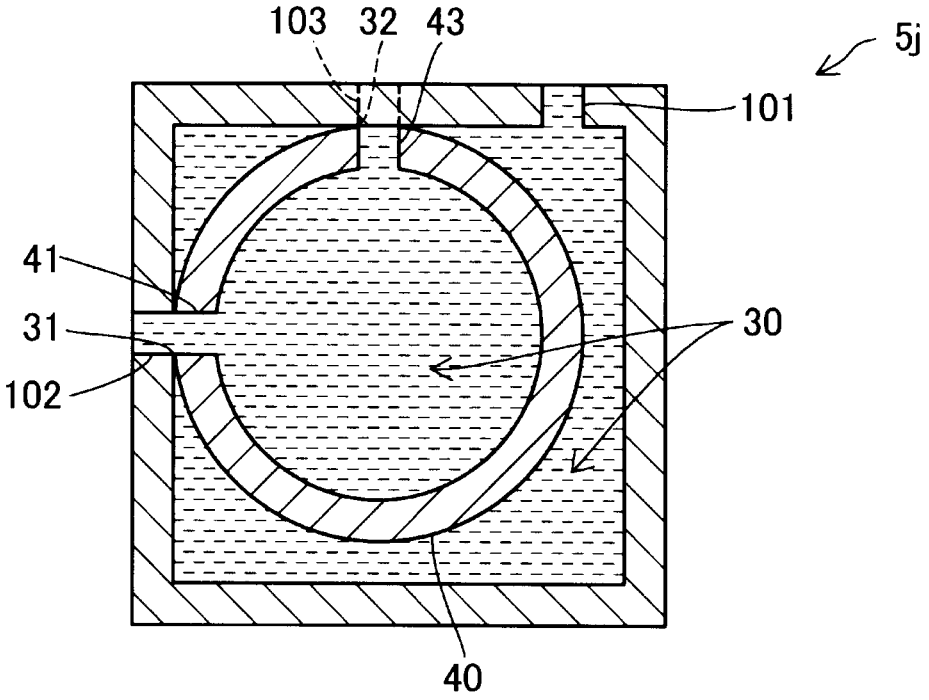
FIG. 16 is a schematic cross-sectional view illustrating the cross-sectional shape of the first slide section according to a tenth embodiment.

FIG. 16 is a schematic cross-sectional view of the first slide section 40 of a liquid ejecting apparatus 5*j* according to a tenth embodiment. The liquid ejecting apparatus 5*j* according to the tenth embodiment is different from that in the seventh embodiment (FIG. 13) in points that a cross-section of the first slide section 40 perpendicular to the longitudinal direction has a hollow, and the internal space of the hollow of the first slide section 40 forms part of the liquid chamber 30. Specifically, the first slide section 40 has a pipe shape in which at least one end portion is opened, and the liquid in the liquid chamber 30 flows into the first slide section 40 from the opened end portion of the first slide section 40. The liquid in the first slide section 40 flows into the pressure chamber 60 through the first through-hole 41, and flows into the circulation flow path 103 through the second through-hole 43.

According to the liquid ejecting apparatus 5*j* of this form, the part of the liquid chamber 30 can be formed in the inside of the first slide section 40, and thus the liquid chamber 30 can be reduced in size. Note that the end portions of the first slide section 40 may not be opened, and a through-hole may be formed on a side surface of the first slide section 40. In this case, the liquid in the liquid chamber 30 flows into the first slide section 40 through the through-hole.

K. Eleventh Embodiment

Figure 17:
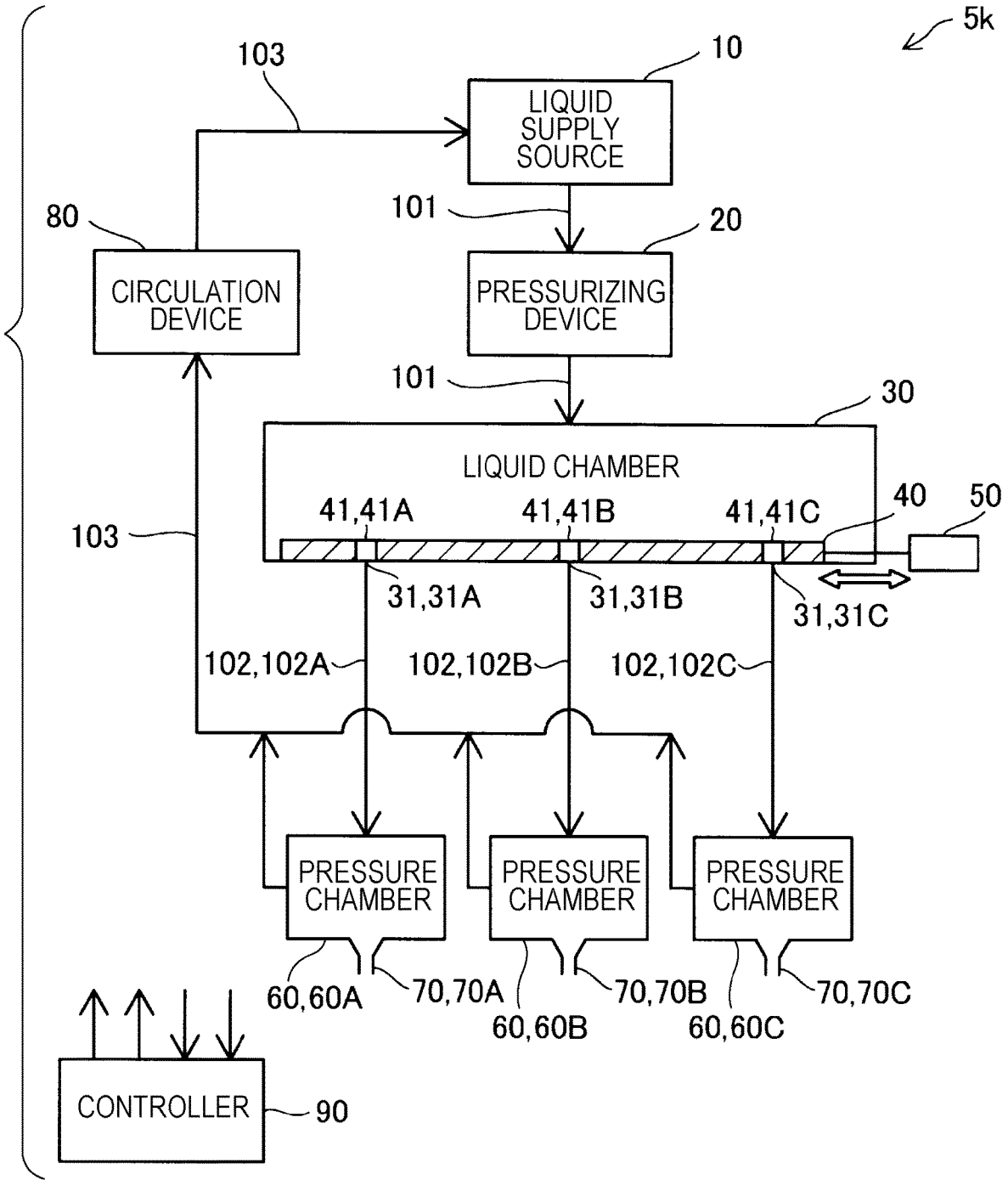
FIG. 17 is a descriptive diagram illustrating the overall configuration of the liquid ejecting apparatus according to an eleventh embodiment.

FIG. 17 is a descriptive diagram illustrating an overall configuration of a liquid ejecting apparatus 5*k* according to an eleventh embodiment. The liquid ejecting apparatus 5*k* according to the eleventh embodiment is different from that in the first embodiment (FIG. 1) in a point that the pressure chamber 60 communicates with the circulation flow path 103 for circulating the liquid in the pressure chamber 60 to the liquid tank 10. Specifically, when the liquid chamber 30 and the pressure chamber 60 are made to be in a communication state by the first slide section 40 being driven, the liquid in the liquid chamber 30 flows into the pressure chamber 60. The liquid in the pressure chamber 60 which is not discharged through the nozzle hole 70 circulates through the circulation flow path 103 to the liquid tank 10. A pressure in the circulation flow path 103 is adjusted, by the circulation device 80 so as to be equal to or smaller than the maximum pressure at which the meniscus of the nozzle hole 70 is not broken.

According to the liquid ejecting apparatus 5*k* of this form as well, the contact area between the first slide section 40 and the inner wall surface of the liquid chamber 30 can be reduced, and thus the heat generation due to the friction at the contact area can be reduced. Additionally, since the circulation flow path 103 is connected not to the liquid chamber 30 but to the pressure chamber 60, it is not necessary to switch, by the first slide section 40 arranged in the liquid chamber 30 being driven, from a state in which the liquid chamber 30 and the pressure chamber 60 communicate with each other to a state in which the liquid chamber 30 and the circulation flow path 103 communicate with each other. Accordingly, in a case where the liquid ejecting apparatus 5 has the circulation flow path 103 as well, a stroke amount (movement amount) of the first slide section 40 can be reduced, and the heat generation due to the friction at the contact area between the first slide section 40 and the inner wall surface of the liquid chamber 30 can be reduced.

L. Twelfth Embodiment

Figure 18:
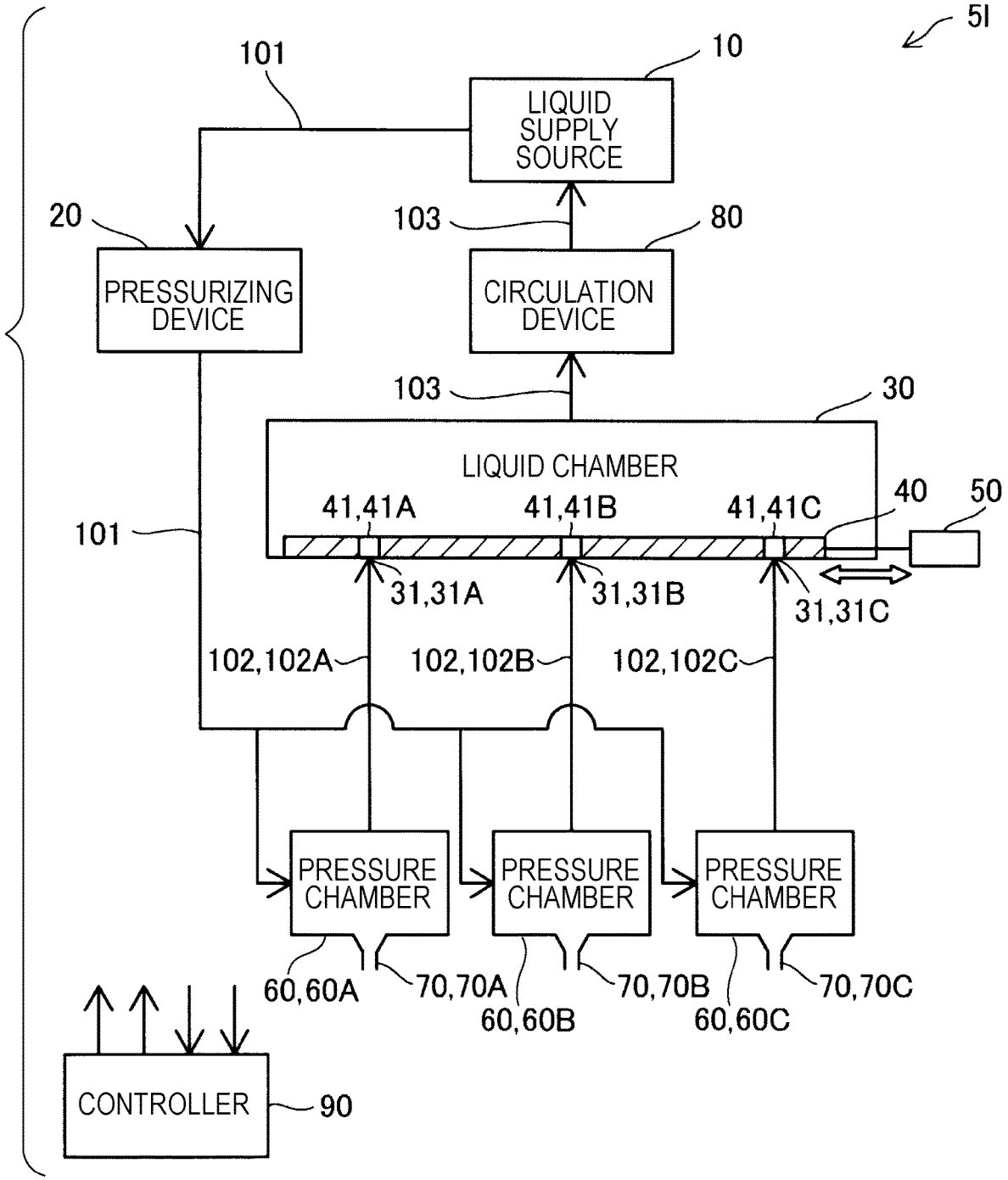
FIG. 18 is a descriptive diagram illustrating the overall configuration of the liquid ejecting apparatus according to a twelfth embodiment.

FIG. 18 is a descriptive diagram illustrating an overall configuration of a liquid ejecting apparatus 5*l* according to a twelfth embodiment. The liquid ejecting apparatus 5*l* according to the twelfth embodiment is different from that in the first embodiment (FIG. 1) in points that the pressure chamber 60 communicates with the liquid tank 10 through the supply flow path 101, the liquid in the pressure chamber 60 flows into the liquid chamber 30 through the first opening 31, and the liquid chamber 30 communicates with the circulation flow path 103 for circulating the liquid in the liquid chamber 30 to the liquid tank 10. Specifically, in the pressure chamber 60, the liquid is supplied from the supply flow path 101. When the liquid chamber 30 and the pressure chamber 60 are made to be in the communication state by the first slide section 40 being driven, the liquid in the pressure chamber 60 which is not discharged through the nozzle hole 70 flows into the liquid chamber 30 through the pressure chamber communication flow path 102. The liquid in the liquid chamber 30 circulates through the circulation flow path 103 to the liquid tank 10 by the circulation device 80. In order to prevent the liquid from leaking through the nozzle hole 70, in a case where there arises a possibility that the pressure in the pressure chamber 60 exceeds the meniscus withstanding pressure of the nozzle hole 70, the first slide section 40 may be driven, the liquid chamber 30 and the pressure chamber 60 may be made to communicate with each other, and the liquid in the pressure chamber 60 may be allowed to flow to the liquid chamber 30. The supply flow path 101 is preferably designed so as to have a larger flow path resistance than that of the pressure chamber communication flow path 102. Pressurizing force of the pressurizing device 20 may be adjusted. Additionally, since the first slide section 40 receives a pressure in a direction separating from the inner wall surface of the liquid chamber 30 by a liquid flow, the first slide section 40 is preferably pressed, for example, against the inner wall surface of the liquid chamber 30 by a spring or the like.

According to the liquid ejecting apparatus 5*l* of this form as well, the contact area between the first slide section 40 and the inner wall surface of the liquid chamber 30 can be reduced, and thus the heat generation due to the friction at the contact area can be reduced. Additionally, although, in a case where the first slide section 40 is pressed against the inner wall surface of the liquid chamber 30, the friction at the contact area between the first slide section 40 and the inner wall surface of the liquid chamber 30 increases, in this case as well, by reducing the contact area between the first slider 40 and the inner wall surface of the liquid chamber 30, the heat generation due to the friction can be suppressed.

M. Thirteenth Embodiment

Figure 19:
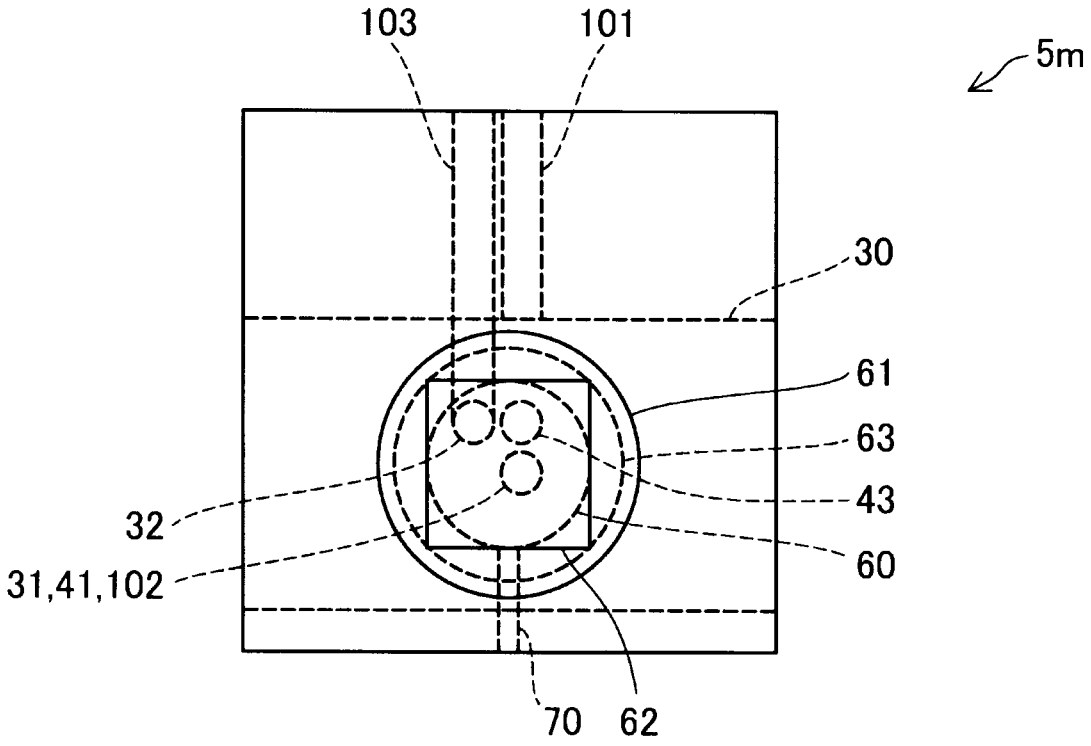
FIG. 19 is a front view illustrating an arrangement of the first opening and a second opening according to a thirteenth embodiment.

FIG. 19 is a front view illustrating an arrangement of the first opening 31 and the second opening 32 in a liquid ejecting apparatus 5*m* according to a thirteenth embodiment. The liquid ejecting apparatus 5*m* according to the thirteenth embodiment is different from that in the first embodiment (FIG. 5) in points of the arrangement of the second opening 32 and the second through-hole 43 being formed in the first slide section 40. Specifically, the second opening 32 is arranged not at a position adjacent to the first opening 31 along the longitudinal direction of the internal space of the liquid chamber 30, but at an upper left position of the first opening 31 in FIG. 19. Additionally, at a position of the first slide section 40 corresponding to the second opening 32, the second through-hole 43 is formed.

According to the liquid ejecting apparatus 5*m* of this form, while maintaining intervals which are necessary for forming the first opening 31 or the second opening 32, the interval between the first opening 31 and the second opening 32 in the longitudinal direction of the internal space of the liquid chamber 30 can be reduced, and the stroke amount of the first slide section 40 can be made slightly larger than a diameter of the flow path such as the pressure chamber communication flow path 102 or the circulation flow path 103. Accordingly, the heat generation due to the friction at the contact area can be reduced.

N. Other Embodiments

N-1. The liquid ejecting apparatus 5 illustrated in FIG. 1 includes the three pressure chambers 60A, 60B, and 60C. In contrast, the number of the pressure chambers 60 may be one, two, or four or more. The same applies to the number of the pressure chambers 60 of the liquid ejecting apparatus 5*k* illustrated in FIG. 17 and the liquid ejecting apparatus 5*l* illustrated in FIG. 18.

N-2. The liquid ejecting apparatus 5 illustrated in FIG. 1 includes the circulation device 80 and the circulation flow path 103, and the second opening 32 is formed on the inner wall surface of the liquid chamber 30. In contrast, the liquid ejecting apparatus 5 may not include the circulation device 80 and the circulation flow path 103, and the second opening 32 may not be formed on the inner wall surface of the liquid chamber 30. In other words, the liquid ejecting apparatus 5 may have a configuration in which the liquid is not circulated from the liquid chamber 30 to the liquid tank 10.

N-3. The driving device 50 illustrated in FIG. 2 to FIG. 3 includes the driving device piezoelectric element 51 and the displacement amplifying mechanism 52. In contrast, the driving device 50 may be configured not of the driving device piezoelectric element 51, for example, but of an air cylinder, a solenoid, or a magnetostriction element, and the driving device 50 may not include the displacement amplifying mechanism 52.

N-4. The internal space of each of the liquid chambers 30 illustrated in FIG. 4 and FIG. 8 to FIG. 12 has a columnar shape. In contrast, the internal space of the liquid chamber 30 may have, for example, a quadrangular prism shape, or a prism shape other than the quadrangular prism shape. Additionally, the internal space of each of the liquid chambers 30 illustrated in FIG. 13 to FIG. 16 has a quadrangular prism shape. In contrast, the internal space of the liquid chamber 30 may have, for example, a columnar shape, or a prism shape other than the quadrangular prism shape. In other words, it is sufficient that a small contact area is formed by the inner wall surface of the liquid chamber 30 and the first slide section 40 making linear contact with each other.

N-5. Each of the first slide sections 40 illustrated in FIG. 4 and FIG. 8 has a columnar shape. In contrast, the first slide section 40 may have, for example, a quadrangular prism shape, or a prism shape other than the quadrangular prism shape. Additionally, the first slide section may have a solid cross-section, or a hollow cross-section. In other words, it is sufficient that a small contact area is formed by the inner wall surface of the liquid chamber 30 and the first slide section 40 making linear contact with each other.

N-6. Each of the liquid chambers 30 illustrated in FIG. 12 to FIG. 16 may have the groove-shaped recessed portion 33 on the inner wall surface on the first opening 31 side as illustrated in FIG. 8. Additionally, the recessed portion 33 may be provided not only on the first opening 31 side but also on the second opening 32 side. Note that a border between the recessed portion 33 and the liquid chamber 30 may be chamfered.

N-7. The invention is not limited to a liquid ejecting apparatus that discharges ink, and can also be applied in any liquid discharge apparatus that discharges other liquids other than the ink. For example, the invention can be applied in various types of liquid discharge apparatuses as described below.

1. An image recording apparatus such as a facsimile machine.
2. A color material discharge apparatus used for manufacturing color filters for an image display apparatus such as a liquid crystal display.
3. An electrode material discharge apparatus used for forming electrodes of an organic EL (Electro Luminescence) display, a surface emission display (Field Emission Display, FED), or the like.
4. A liquid discharge apparatus that discharges a liquid including bioorganic materials used for manufacturing biochips.
5. A sample discharge apparatus as a precision pipette.
6. A lubricating oil discharge apparatus.
7. A resin liquid discharge apparatus.
8. A liquid discharge apparatus for pinpoint discharge of lubricating oil on precision machines such as watches and cameras.
9. A liquid discharge apparatus that discharges a transparent resin liquid, such as an ultraviolet curable resin liquid, onto a substrate in order to form a minute hemispherical lens (optical lens) or the like used for optical communication elements or the like.
10. A liquid discharge apparatus that discharges an acidic or alkaline etching liquid in order to perform etching on a substrate or the like.
11. A liquid discharge apparatus including a liquid discharge head configured to discharge a very small amount of any other liquid droplets.

It should be noted that the "liquid droplet" refers to a state of liquid discharged from the liquid discharge apparatus and includes a granular shape, a teardrop shape, or a shape having a thread-like trailing end. Additionally, the "liquid" in this case may be any material that can be consumed by the liquid discharge apparatus. For example, the "liquid" may be any material in a state when a substance is in a liquid phase, and liquid-state materials with high or low viscosity, sols, gel water, and other liquid-state materials such as inorganic solvents, organic solvents, solutions, liquid resins, and liquid metals (metal melts) are also included in the "liquid". Additionally, the "liquid" includes not only the liquid as one state of a substance but also materials in which solvent contains dissolved, dispersed, or mixed particles of functional material made of a solid such as pigments or metal particles. Typical examples of the liquid include ink, a liquid crystal, and the like. Here, it is assumed that the ink includes general water-based ink and oil-based ink, and various liquid state compositions such as gel ink and hot-melt ink.

The invention is not limited to the above-described embodiments, and can be implemented by various configurations without departing from the essential spirit of the invention. For example, the technical features of the embodiments corresponding to the technical features of each of the aspects described in Summary may be replaced or combined appropriately in order to solve part or all of the problems described above or in order to achieve part or all of the advantageous effects described above. Any of the technical features may be omitted appropriately unless the technical feature is described as essential in this specification.

The entire disclosure of Japanese Patent Application No. 2017-229731, filed Nov. 30, 2017 is incorporated by reference herein.

What is claimed is:

1. A liquid ejecting apparatus comprising:
a liquid chamber having a first opening;
a first slider having a first through-hole, and makes linear contact with an inner wall surface of the liquid chamber;
a pressure chamber configured to communicate with the pressure chamber communication flow path;
a nozzle hole configured to communicate with the pressure chamber; and
an actuator configured to drive the first slider along a first direction;
a pressure chamber communication flow path configured to connected to the first opening;
a controller configured to control operation of the actuator; wherein
the first opening being located on the inner wall surface of the liquid chamber, the first opening overlapping the first through-hole in a view from a second direction perpendicular to the first opening, and
the controller changing the area where the first through-hole and the first opening overlap in a view from the second direction by sliding the first slider.

* * * * *